US005491857A

United States Patent [19]

Love, III et al.

[11] Patent Number: 5,491,857

[45] Date of Patent: Feb. 20, 1996

[54] METHOD AND APPARATUS FOR TREATMENT OF PILE FABRIC

[75] Inventors: Franklin S. Love, III, Columbus, N.C.; Wesley D. Christie, Inman, S.C.

[73] Assignee: Milliken Research Corporation, Spartanburg, S.C.

[21] Appl. No.: 932,908

[22] Filed: Aug. 19, 1992

Related U.S. Application Data

[63] Continuation of Ser. No. 720,146, Jun. 24, 1991, abandoned.

[51] Int. Cl.[6] ..... D06B 5/02

[52] U.S. Cl. ..... 8/151; 68/205 R; 26/2 R; 28/167

[58] Field of Search ..... 8/151, 158; 68/205 R, 68/62; 28/162, 167, 160, 159; 26/2 R

[56] References Cited

U.S. PATENT DOCUMENTS

| | | | |
|---|---|---|---|
| 1,417,587 | 5/1922 | Tully | 26/2 R |
| 1,771,144 | 7/1930 | Ruhe et al. | 68/5 B X |
| 2,170,968 | 8/1939 | Gentle | 68/5 B X |
| 2,241,222 | 5/1941 | Sonnino | 68/5 B X |
| 2,532,471 | 12/1950 | Welder | 68/205 R X |
| 2,613,521 | 10/1952 | Walmslel | 68/62 |
| 2,634,221 | 4/1953 | McAlpine et al. | 68/205 R X |
| 2,729,536 | 1/1956 | Pull et al. | 68/5 B X |
| 2,970,362 | 2/1961 | Rankin et al. | 26/2 |
| 3,205,686 | 9/1965 | Norton | 68/205 R X |
| 3,222,895 | 12/1965 | Sheppard | 68/205 R X |
| 3,292,228 | 12/1966 | Tignerr | 26/2 R |
| 3,589,147 | 6/1971 | Price et al. | 68/5 |
| 3,611,757 | 10/1971 | Hills | 68/5 B |
| 3,739,436 | 6/1973 | Naujoks et al. | 26/2 R |
| 3,739,483 | 6/1973 | Meier-Windhorst | 34/23 |
| 3,997,946 | 12/1976 | Hergert | 26/2 R |
| 4,301,577 | 11/1981 | Mueller et al. | 26/2 R |
| 4,923,743 | 5/1990 | Stewart, Jr. | 68/205 R X |

FOREIGN PATENT DOCUMENTS

| | | | |
|---|---|---|---|
| 1276585 | 9/1968 | Germany . | |
| 2745895 | 4/1979 | Germany | 68/62 |
| 3006372 | 8/1981 | Germany | 68/205 R |
| 3031665 | 4/1982 | Germany . | |
| 60-75664 | 4/1985 | Japan | 26/2 R |
| 3-45774 | 2/1991 | Japan | 68/205 R |
| 342519 | 2/1931 | United Kingdom | 68/5 B |
| 570480 | 7/1945 | United Kingdom | 68/205 R |
| 952819 | 3/1964 | United Kingdom | 68/5 B |

*Primary Examiner*—Frankie L. Stinson
*Attorney, Agent, or Firm*—Terry T. Moyer; Kevin M. Kercher

[57] ABSTRACT

A method and apparatus for continuous treatment of webs of fabric having an upright pile comprising spraying the pile fabric with a sheet of liquid and then optionally heat-setting the fabric. The spraying of pile fibers allows the fibers to return to their preferred upright orientation.

19 Claims, 4 Drawing Sheets

METHOD AND APPARATUS FOR TREATMENT OF PILE FABRIC

BACKGROUND OF THE INVENTION

This application is a continuation of Ser. No. 720,146, filed Jun. 24, 1994, now abandoned.

This invention relates to improved method and apparatus for removing pile distortions in fabric created by heat-setting and/or dyeing and/or upon treatment by high pressure streams of liquid.

In the case of pile fabrics, which have been heat set at a high temperature with the pile erect and then dyed at a lower temperature during which the pile is substantially disturbed, as in jet dyeing, it is then desired to have the pile return to its original erect condition. One attempt in solving this problem is the tensionless dryer. In this machine, the pile fabric is fed onto a mesh belt that is then transported through a long heated tunnel where either mechanical action or perpendicular air blasts directed at the belt cause the fabric to undergo rather gentle undulations. The fabric is statically charged by friction with the air or contact with various parts of the dryer. The required processing time results in a drying unit over one hundred feet long with a low fabric line speed. There are quality problems associated with a lack of control over the fabric for such a long distance and well as marks that occur when the fabric strikes the upper section of the tunnel.

Another type of pile conditioning device is the use of a high velocity air jet such as U.S. Pat. No. 4,837,902. In this case, the fabric is heated to the desired temperature and the conditioning is accomplished almost instantaneously by vigorous sawtoothed shaped waves that are small in amplitude, but effective due to high accelerations normal to the fabric surface produced by the wave's small bending radius and high velocity. The disadvantage of this process is direct contact of the heated fabric with the air stream, which tensions the fabric and can set in distortions in sensitive knit fabrics. Also, this process is less effective with highly permeable fabrics, as the air may not be trapped between the fabric and plate.

Yet another type of device vibrates and charges the pile fabric in the heated condition by contact with pneumatically excited diaphragms. The contact of the fabric with the diaphragms combined with the rapid vibrations induced by the air stream cause the diaphragm to wear out at a rate in which replacement can be a daily occurrence.

Still another type of device vibrates and charges the pile fabric biaxially by means of a rotating cylindrical roll with spaced protrusions or depressions along the exterior surface of the cylinder, followed by optionally vibrating the fabric axially by means of a second rotating cylindrical roll having flat portions continuously extending along the longitudinal axis of the second cylinder. The repeated and rapid front to back and side to side movement of individual pile fibers caused by multiple vibrational waves during biaxial treatment allows the fibers to return to their preferred heat-set orientation.

The present invention solves the above problems in a manner not disclosed in the known prior art.

SUMMARY OF THE INVENTION

A method and apparatus for continuous treatment of webs of fabric having an upright pile comprising spraying the pile fabric with a sheet of liquid and then optionally heat-setting the fabric. The spraying of pile fibers allows the fibers to return to their preferred upright orientation.

An advantage of this invention is that heat is not involved in the reorientation process so that the pile fabric is less distressed or deformed than current reorientation methods.

It is another advantage of this invention to provide for a uniformity of face finish. The forces involved in the process are aligned with the direction of the desired pile orientation.

Yet another advantage of this invention is that a hot tenter frame is not needed, which is a very costly and time consuming operation.

Still another advantage of this invention is that it is simple and reliable and provides a distinct improvement in quality.

Another advantage of this invention is that the fabric does not undergo shrinking that is the result of a heat-type drying stage and can undergo further wet-type processing downstream.

These and other advantages will be in part apparent and in part pointed out below.

BRIEF DESCRIPTION OF THE DRAWINGS

The above as well as other objects of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
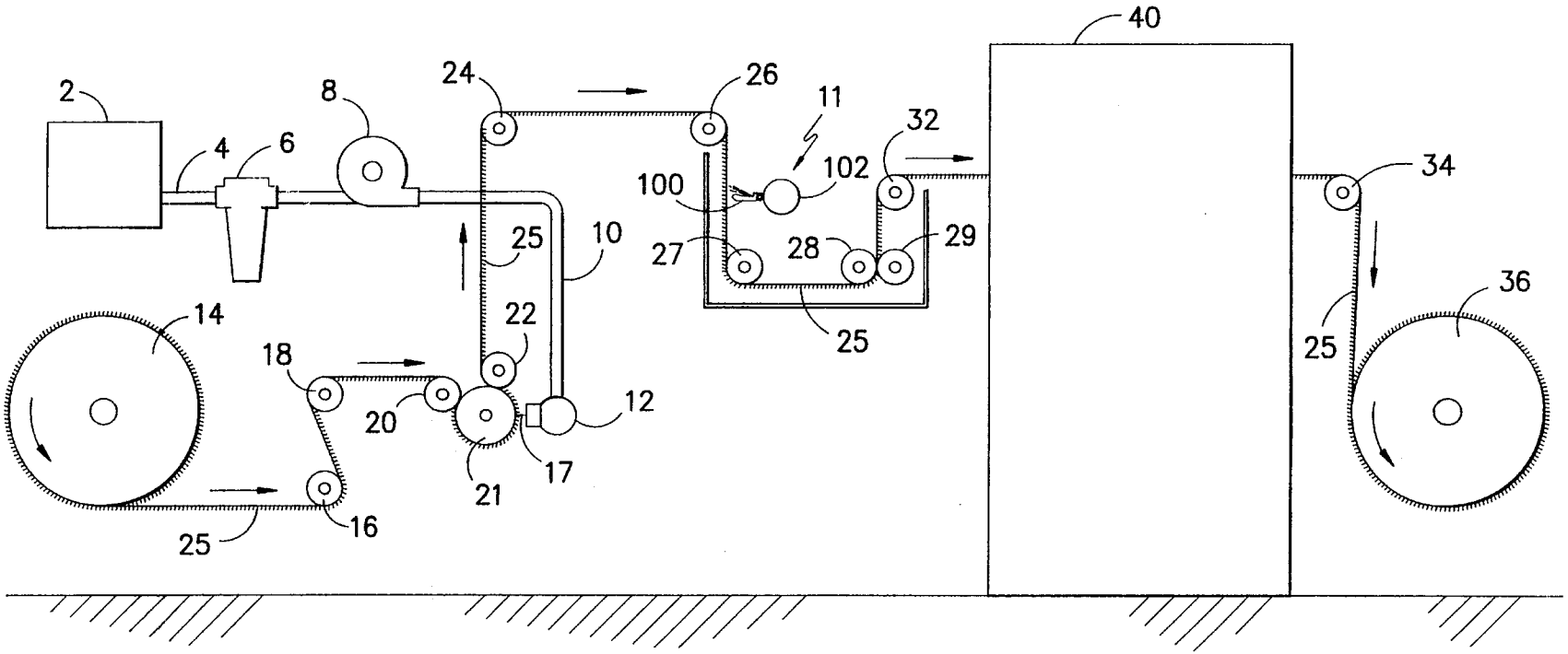
FIG. 1 is a diagrammatic side elevational view of the apparatus constructed according to the present invention with the fabric being patterned by a liquid stream, then having the pile restored by means of a liquid spray and then heat set.
Figure 2:
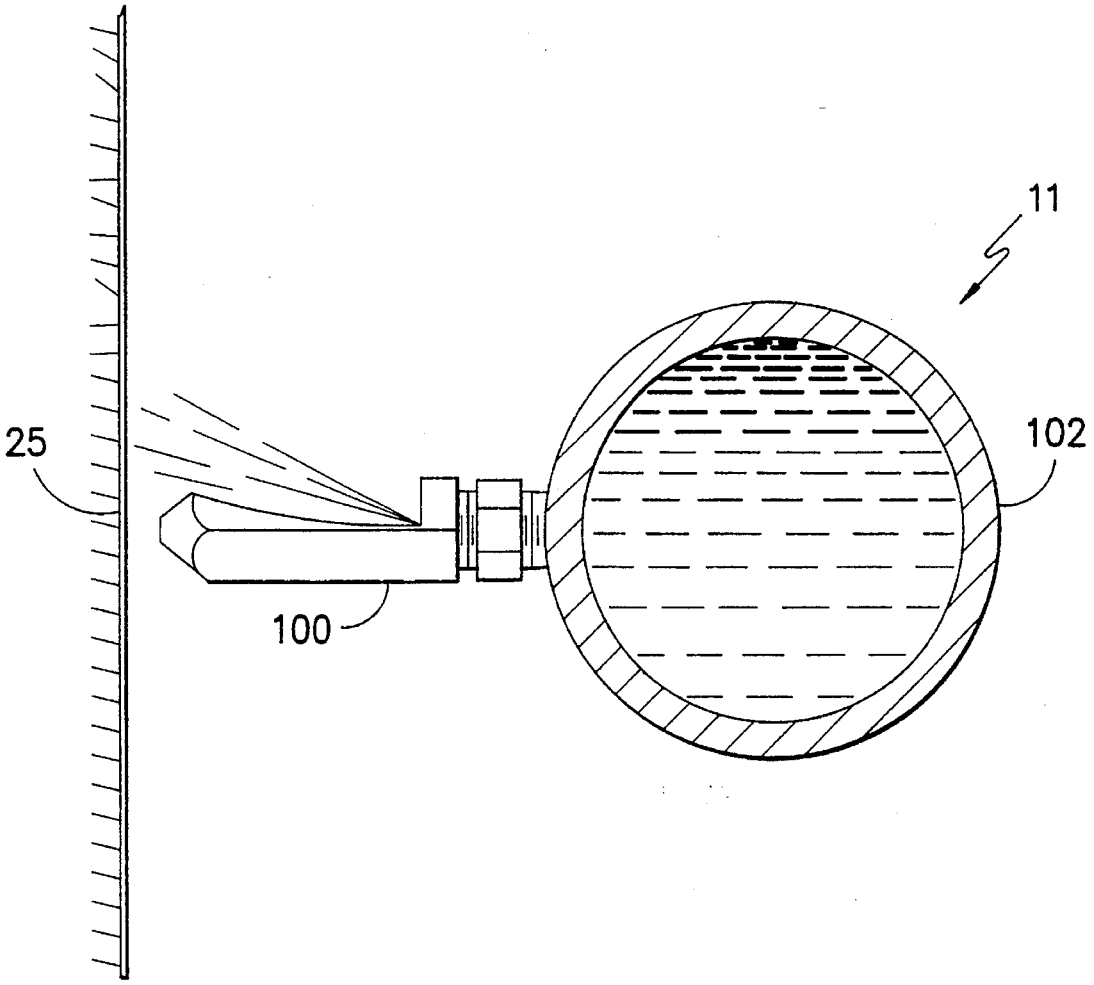
FIG. 2 is a diagrammatic side view of the liquid spray of FIG. 1, showing only the liquid spay means striking a pile fabric.
Figure 3:
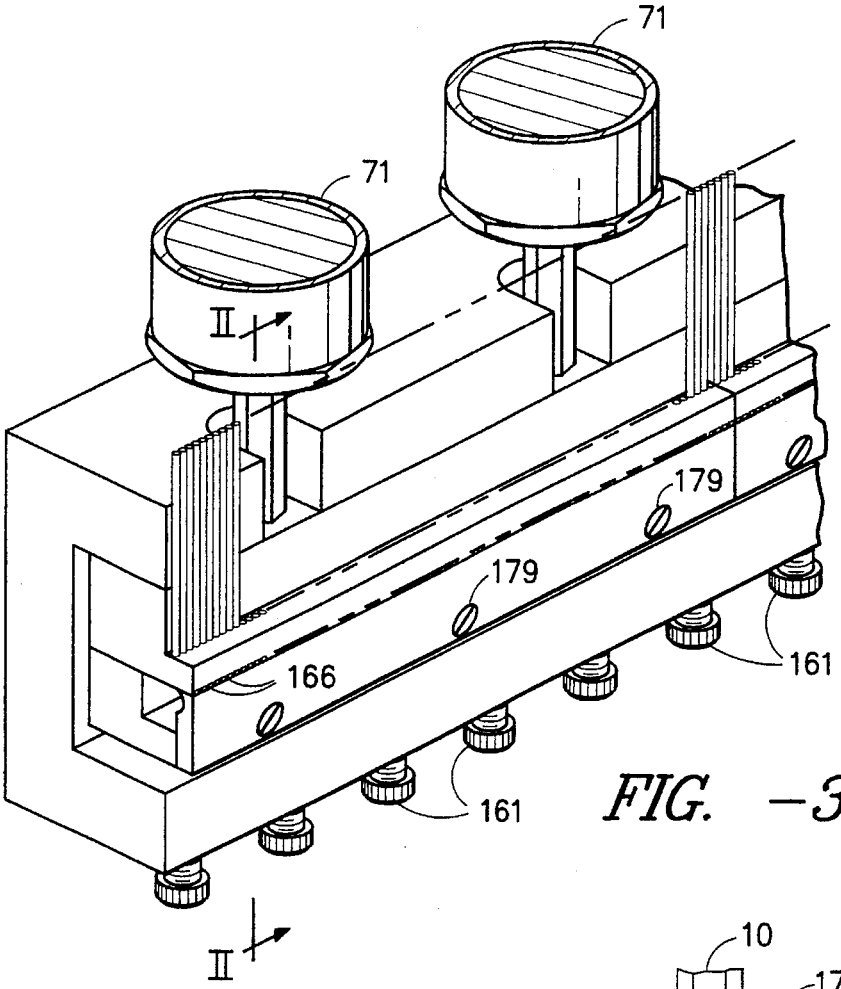
FIG. 3 is a perspective view of an apparatus embodying the instant invention wherein a transverse stream of a control fluid is used to interrupt the fluid streams confined in channels or grooves 166.

Referring now by reference numerals to the drawings, and first to FIGS. 1–2, an assembly to erect pile fabric is generally indicated by numeral 11. Referring now to FIG. 1, pile fabric 25 is initially removed, with the pile side down, from the underside of supply roll 14. The fabric 25 is then directed vertically upward by a first idler roll 16 then substantially in a horizontal direction by second idler roll 18. The pile fabric 25 then comes in contact with third idler roll 20 that positions the fabric around treatment roll 21. The treatment that occurs at treatment roll 21 is that of patterning and/or napping fabric by means of high velocity liquid stream(s). The apparatus and method of this invention will operate to restore any pile fabric regardless of the cause of disorientation and the high velocity liquid stream(s) treatment is merely included as an illustrative example. The high velocity liquid stream treatment, as shown in FIG. 1, includes a pump 8 connected to a source 2 of the desired working fluid, e.g., water, via conduit 4 and filter assembly 6. Filter assembly 6 is intended to remove undesirable particulate matter from the working liquid that could clog the various orifice assemblies discussed below in more detail. The high pressure output of pump 8 is fed, via high pressure conduit 10 to high velocity fluid orifice assembly 12. Orifice assembly 12 is disclosed in detail by FIGS. 3–6 and will be discussed later below. Conduit 10 may be any suitable conduit capable of safely accommodating the desired fluid pressures and flow rates, and having sufficient flexibility or rigidity to permit orifice assembly 12 to be positioned as desired with respect to the pile fabric to be treated.

Situated in close proximity to orifice assembly 12 is treatment roll 21, over which the textile fabric to be treated is placed. Generally, roll 21 has a solid, smooth, inflexible surface (e.g., polished aluminum or stainless steel); a roll having a specially treated or formed surface may be useful in achieving certain special effects on selected substrates. It has been found, for example, that use of a contoured roll surface may result in patterning effects corresponding to the roll surface contours on the substrate.

Associated with roll 21 is textile fabric 25, which may be in the form of a continuously moving web that is positioned against a portion of roll 21.

In order to generate a pattern on textile fabric 25, contact between the fabric and the high velocity stream of fluid emanating from orifice assembly 12 must be established and interrupted in a way that corresponds to the desired length and lateral spacing of the stripes comprising the pattern. Where a solid area is to be treated, the fluid streams may be made to contact the fabric in closely adjacent or overlapping stripes.

In operation, a working fluid, e.g., water, is pumped by pump 8 from fluid source 2, through filter means 6 to the orifice assembly 12. If the portion of fabric 25 directly opposite orifice assembly 12 is to be treated, a valve (not shown) is made to open, e.g., via an electrical or pneumatic command signal, and high pressure water is allowed to pass via conduit 10 to orifice assembly 12, where a thin, high velocity water jet 17 is formed and directed onto the fabric 25. When the desired pattern requires that jet 17 not impact the fabric 25, an appropriate electrically or pneumatically transmitted instruction causes the valve to close. Positioning the desired areas of fabric surface under the jet 17 can be achieved by proper coordination of rotation of roll 21, which preferably may be accomplished by computer control, in conjunction with a rotation sensor mounted in association with roll 21.

Assuming that appropriate indicating means are used to specify, via a digital signal, the exact rotational position of roll 21, a computer may be used to generate on/off instructions the valve (not shown) in accordance with pre-programmed pattern data. It is contemplated that roll 21 may be made to rotate continuously, in incremental linear steps, along the axis of the roll with the fabric 25 in the form of a web traveling over roll 21, which better lends itself to commercial production methods.

It should be understood that, if desired, an orifice assembly 12 that can generate a multiple jet array is the preferred embodiment in most commercial applications, particularly if computer control is available to control the actuation of the multiple valves necessary in such system.

After the optional treatment, the pile fabric 25 is redirected vertically upward for a distance by fourth idler roll 22 that is adjacent the treatment roll 21. The pile fabric 25 is then directed horizontally by fifth idler roll 24. The pile fabric travels horizontally for a distance and then is directed downward by sixth idler roll 26.

The pile fabric is then treated, in its downward travel, by the pile reorientation means, generally indicated as the numeral 11, comprising of a flat spray nozzle 100 manufactured by Spraying Systems Company of Wheaton, Ill. (Model- Flat Jet, Part No. 3/8P1530). This nozzle can be of a variety of shapes such as conical, oblong, and so forth, but it is found that a flat nozzle is preferred. This flat spray nozzle creates a sheet of water directed against the back of the pile fabric 25. It is also believed that a spray transverse to the face of the fabric could achieve the same result by lifting the pile back into an upright position. The maximum possible range of values in pounds per square inch gauge is between 10 and 600. A more practical operating range is 30 to 200 p.s.i.g. with the preferred operating range being between 40 and 60 p.s.i.g. Another critical parameter is the minimum cross sectional dimension of the orifice. The maximum possible range of values for this parameter is between 0.000019 and 0.79 square inches. A more practical operating range is between 0.003 to 0.19 square inches with the preferred operating range being between 0.012 and 0.027 square inches.

Still another important parameter is that of the distance of the pile fabric 25 to the spray nozzle 100. This distance has an outer range of 0.0625 to 24 inches with a more practical range of 1 to 15 inches and a preferred range of 4 to 10 inches as the optimal operating condition.

The only other critical parameter of this invention includes the angle of the spray nozzle 100 from a line normal to the back of the pile fabric 25. This angle has an outer limit of 0 to 70 degrees with a more practical range of 10 to 50 degrees and a preferred range of 20 to 40 degrees as the optimal operating condition. This angle is basically designated as the angle that is in alignment with the optimal orientation of the pile fabric 25. If sprayed from the front of the pile fabric 25, this angle has an outer limit of 90 to 45 degrees with a more practical range of 85 to 55 degrees and a preferred range of 80 to 60 degrees as the optimal operating condition. This angle is basically designated as the angle to lift the pile back into optimal orientation.

The flat spray nozzle 100 is supplied liquid, preferably water, from a manifold 102 that can be constructed of a variety of materials such as polyvinyl chloride, stainless steel, and so forth. The manifold 102 is threadedly attached to the flat spray nozzle in the preferred embodiment, which is shown in greater detail in FIG. 2.

After receiving the spray treatment, the pile fabric 25 is once again redirected by seventh idler roll 27 into a horizontal plane. The pile fabric 25 is then guided upward vertically by the eighth and ninth dual idler wheels 28 and 29, respectively, while being simultaneously held in position. The pile fabric 25 then passes over tenth idler roll 32 for horizontal entry into the drying chamber 40 comprising of a series of steam cans. An example of a "steam can" heating element is that of a steam heated plate disclosed in commonly assigned U.S. Pat. No. 4,947,528 entitled "Method and Apparatus to Erect Pile Fiber" and issued on Aug. 14, 1990. The disclosure thereof is incorporated herein by reference for full description and clear understanding of the improved features of the present invention. Each steam can is typically held at 280 degrees Fahrenheit.

The pile fabric is heat set when the temperature on the face of the pile fabric 25 being lower than that of the back of the fabric 25. This process permanently fixes the pile orientation. The steam can is only one means of heat setting the pile fabric with a host of other possible means including oven and tenter frame, and so forth.

The temperature on the face of the fabric has an outer limit of 150 to 320 degrees Fahrenheit a more practical range of 190 to 300 degrees Fahrenheit and a preferred range of 200 to 290 degrees Fahrenheit as the optimal operating condition. The temperature on the back of the fabric has an outer limit of 145 to 310 degrees Fahrenheit a more practical range of 180 to 290 degrees Fahrenheit and a preferred range of 190 to 280 degrees Fahrenheit as the optimal operating condition.

The pile fabric 25, once outside of the heat setting chamber 40, is then directed vertically downward by eleventh idler roll 34. The pile fabric is then received by take-up roll 36.

FIGS. 3 through 7 depict the high velocity fluid orifice assembly as previously referenced, which may be used for the purpose of forming and interrupting the flow of a fluid stream in an open channel. This apparatus may, if desired, be used to interrupt intermittently the flow of a high pressure liquid stream, but is by no means limited to such application. Low pressure liquid streams, as well as gas streams at various velocities, may be selectively interrupted using the teachings herein. For purposes of the discussion which follows, however, it will be assumed that the fluid stream flowing in the channel is a liquid at relatively high velocity.

Figure 4:
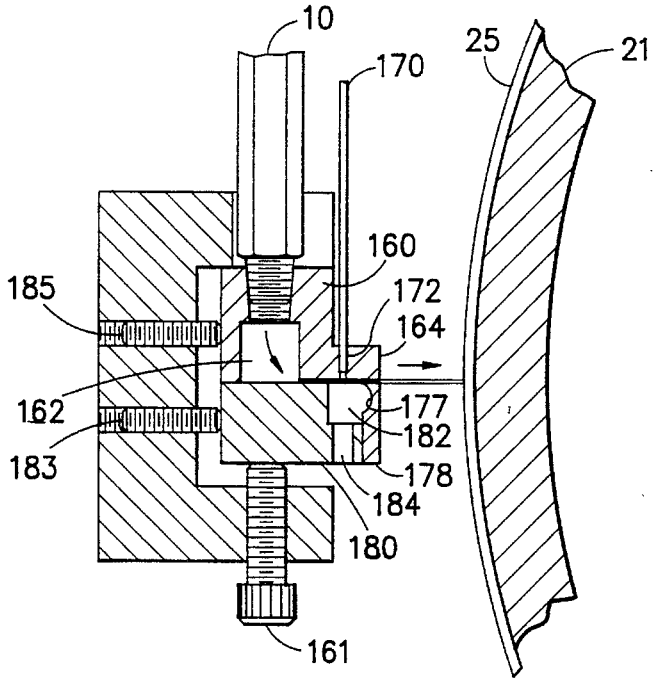
FIG. 4 is a section view taking along lines II—II of FIG. 3 and depicts the apparatus wherein a fluid stream is directed at a textile substrate.

As seen in the section view of FIG. 4, a conduit 10 supplies, via filter 71 (FIG. 3), a high pressure working fluid to manifold cavity 162 formed within inlet manifold block 160. Flange 164 is formed along one side of manifold block 160; into the base of flange 164 is cut a uniformly spaced series of parallel channels or grooves 166. Each groove 166 extends from cavity 162 to the forward-most edge of flange 164 and has cross-sectional dimensions corresponding to the desired cross-sectional dimensions of the stream. Thus, for example, the groove may have a cross-section resembling the letter "U", or may have a totally arbitrary shape. Control tubes 170, through which streams of relatively low pressure air or other control fluid are passed on command, are arranged in one-to-one relationship with grooves 166, and are, in one embodiment, positioned substantially in alignment with and perpendicular to grooves 166 by means of a series of sockets or wells 172 in flange 164, each of which is placed in direct vertical alignment with a respective groove 166 in flange 164, and into which each tube 170 is securely fastened. The floor of each socket 172 has a small passage 174 which in turn communicates directly with the base of its respective groove 166.

Positioned opposite inlet manifold block 160 and securely abutted thereto via bolts 161 are outlet manifold block 180 and optional containment plate 178. Containment plate 178 may be attached to outlet manifold block 180 by means of screws 179 or other suitable means. Within outlet manifold block 180 is machined optional discharge cavity 182 and outlet drain 184. Discharge cavity 182 and outlet drain 184 may extend across several grooves 166 in flange 164, or individual cavities and outlets for each groove 166 may be provided. It is preferred, however, that cavity 182 be positioned so that passage 174 leads directly into cavity 182, and not led into the upper surface of outlet manifold block 180 or containment plate 178. Discharge cavity 182 includes impact cavity 177 which is machined into containment plate 178. Bolts 183 and 185 provide adjustment of the relative alignment between inlet manifold block 160 and the combination of outlet manifold block 180 and containment plate 178.

In operation, a working fluid is fed into inlet cavity 162, where it is forced to flow through a first enclosed passage, formed by grooves 166 in flange 164 and the face of outlet manifold block 180 opposite flange 164, thereby forming the fluid into discrete streams having the desired cross-sectional shape and area. The pre-formed streams may be positioned within grooves 166 so that reduced or substantially no contact between the streams and the floor or base of grooves 166 occurs, and that substantially all contact between the streams and the grooves take place at the groove walls, which walls thereby define the lateral boundaries of the streams.

It has been discovered that, so long as control tubes 170 remain inactivated, i.e., so long as no control fluid from tubes 170 is allowed to intrude into grooves 166 at any significant pressure, the streams of working fluid may be made to traverse the width of discharge cavity 182 in an open channel formed only by grooves 166 without a significant loss in the coherency or change in the cross-sectional shape or size of the stream, although under certain conditions, some slight spreading of the stream in a direction parallel to the groove walls and normal to the groove floor may occur. After traversing the width of discharge cavity 182, the streams encounter the edge of optional containment plate 178, whereupon the streams are made to flow in a second completely enclosed passage, formed by grooves 166 in flange 164 and the upper end of containment plate 178, just prior to being ejected in the direction of the desired target 25, e.g., a textile substrate. Where precise stream definition is necessary, e.g., in the direction of the open portion of grooves 166, use of containment plate 178 or similar structure is preferred. Such use affords an opportunity to re-define the stream cross-section to exact specification, as defined by the cross-section of this second completely enclosed passage, at extremely close distances to the desired target, thereby virtually eliminating the effects of any significant stream spreading. The ability to define the stream's cross-section at extremely close distances to the target, which occurs even without the use of plate 178 as a consequence of the stream flowing uninterruptedly in grooves 166, serves to minimize any stream placement inaccuracies due to slight non-parallelism in adjacent grooves 166 or problems resulting from the presence of nicks or burrs in the grooves. It is considered an advantageous feature of this invention that passing said stream through a second enclosed passage, and thereby allowing re-definition of the stream cross-section about the entire stream cross-section perimeter, may be achieved without the stream having to leave grooves 166.

Figure 5:
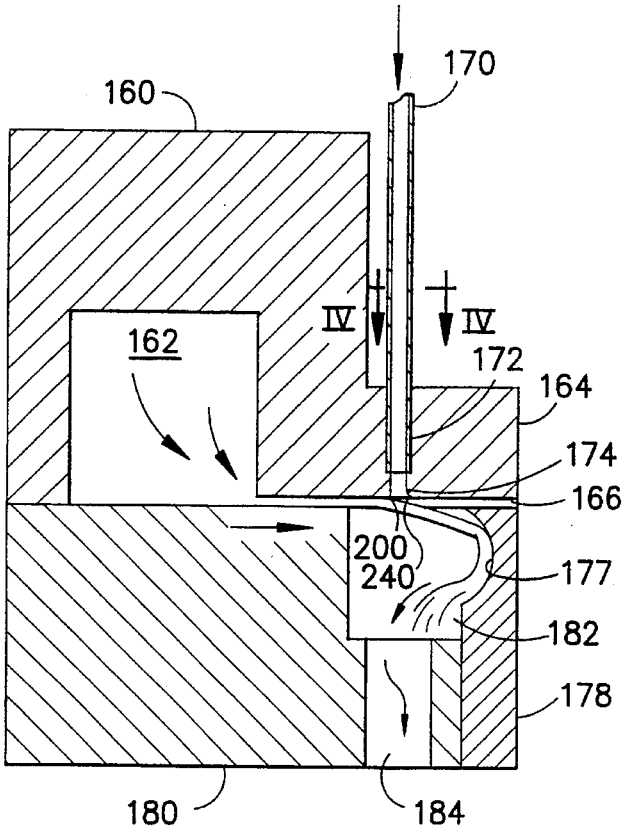
FIG. 5 is an enlarged section view of the inlet and discharge cavity portion of the apparatus of FIG. 4, showing the effects of energizing the control stream.
Figure 6:
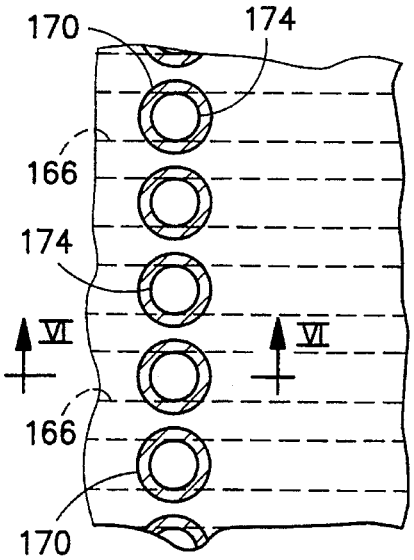
FIG. 6 is a section view taken along lines IV—IV of FIG. 5.
Figure 7:
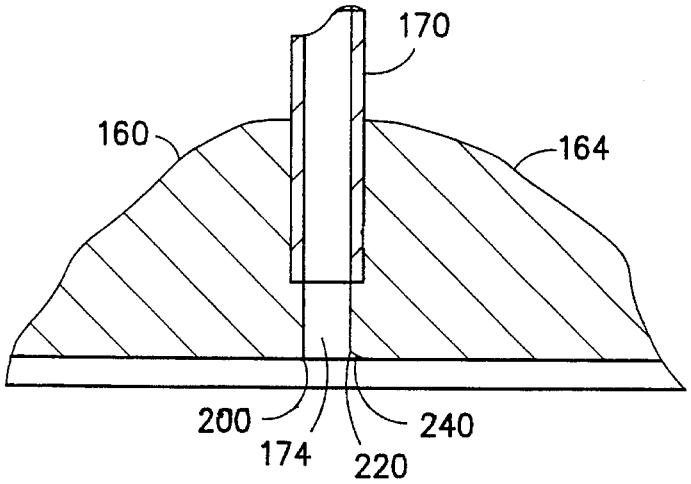
FIG. 7 is a blown-up view of the grooves shown in FIGS. 4 and 5.

To interrupt the flow of working fluid which exits from grooves 166 in the direction of the desired target 25, it is necessary only to direct a relatively small quantity of relatively low pressure air or other control fluid, through the individual control tubes 170, into the associated grooves 166 in which flow is to be interrupted and under the working fluid stream. For purposes herein, the term "under" as used in this context shall mean a position between the working fluid stream within the groove and the base of the groove. As depicted in FIG. 5, the control fluid, even though it may be at a vastly lower pressure (e.g., one twentieth or less) than the working fluid, is able to life and divert the working fluid stream defined by the walls of groove 166 and can cause instabilities in the stream which, for example, where the working fluid is a relatively high velocity liquid, may lead to virtual disintegration of the working fluid stream. While, for diagrammatic convenience, FIG. 5 indicates a liquid stream which is merely lifted from the groove and deflected into the curved containment cavity 177 of containment plate 178, in fact, a high velocity liquid stream is observed to be almost completely disintegrated by the intrusion of a relatively low pressure control fluid stream as soon as the liquid stream passes the point where the control fluid stream is introduced into the grooves and the working liquid stream begins to lift from the groove. It is believed containment cavity 177 and containment plate 178 serve principally to contain the energetic mist which results from such disintegration, and are not necessary in all applications. Likewise, if disposing of the interrupted fluid presents no problem, discharge cavity 182 need not be provided and the interrupted fluid may simply be allowed to drain or disperse in place.

The following Example is intended to illustrate details of the instant invention and are not intended to be limiting in any way.

EXAMPLE

A multiple stream nozzle was fabricated as follows: a stainless steel bar six inches long and approximately one inch wide was slotted at 10 slots per inch for the full 6" length. The slots were 0.030" wide by 0.008" deep by 7/16" long, and extended to an edge of the bar. Centered on the slot length of one of the slots, one 0.028" hole is drilled; the depth of the hole was approximately 0.032". Also centered on the same slot, a 0.042" hole was drilled from the back side of the bar so as to communicate with the single 0.028" hole. A lead and gold plated flat clamping plate was used to seal the nozzle and cover approximately 0.125 of 7/16" groove length, and was positioned to be aligned with but not cover the hole. Screws were used to hold the clamping plate to the nozzle. A deflector plate was then placed about 0.065" beyond the 0.028" hole; the edge of the deflector plate rested on the tops of the grooves. To demonstrate the effectiveness of the apparatus, the nozzle was pressurized with water at a pressure of 1600 p.s.i.g. The flow rate from each of the jets was 0.41 gallons per minute. A 0.125" hole associated with a single slot was then connected to a source of pressurized air through a 24 volt Tomita Tom-Boy JC-300 electric air valve (manufactured by Tomita Co., Ltd., No. 18–16. 1 Chome, Ohmorinaka, Ohta-ku, Tokyo, Japan). The air pressure was set at 65 p.s.i.g. By opening the air valve, the water jet could be deflected out of the chosen slot and caused to disintegrate, thereby interrupting the flow of the high pressure water jet from the nozzle. Crisp control of the water stream was observed, with extremely fast response time in switching from "stream on" to "stream off" conditions, as well as vice versa.

In the operation of the apparatus described, it has been found that fluid in the grooves 166 tends to go up into passage 174 once it leaves the sharp edge 200 on the downstream side of the passage 174. This is a natural phenomenon since a stream of confined liquid fans out when freed from the constraining force. This fluid in the passage 174 creates numerous problems in the operation of the described apparatus. One problem is that the fluid in the passage 174 must be blown out when the air in the tubes is cut on resulting in a slower reaction time resulting in definition problems on the fabric 25 being treated. Also the fluid in the passage 174 tends to get into the air valves and in time results in defective valve action. Furthermore, the fluid in the passage 174 can cause a back pressure which will cause the air hoses to be blown off when air is supplied.

Whenever a fluid expands or fans out it does so at an angle which can be determined so that the impingement point 220 on the downstream side of the passage 174 can be calculated. Since the impingement point 220 is known, the upstream edge 240 of the hole or passage 174 is curved downward to a point tangential to the upper surface of the groove 166 so that the fluid will be guided into and through the position of the passage 166 downstream of the passage 174 rather than backing up into same.

By experimentation and testing, it has been found that when the convex or curved edge 240 of the passage approaches a sine curve maximum reflection of the fanned out fluid into the passage 166 occurs. This curve is defined by the equation:

$$Z = -l + l\sin e\left(\frac{\pi y}{2m}\right)$$

where z=vertical axis y=horizontal axis l=vertical distance from the centerline of the groove to the impingement point 220 m=horizontal distance between the impingement point 220 to tangent point of the curve In the preferred form of the invention l=0.005 and m=0.013.

It is not intended that the scope of the invention be limited to the specific embodiment illustrated and described. Rather, it is intended that the scope of the invention be defined by the appended claims and their equivalents.

What is claimed is:

1. A process for removing distortions in pile fabric comprising the step of directly spraying said pile fabric, having a front and back, with a plurality of streams of liquid on said back of said pile fabric at a peak dynamic pressure in excess of about 10 p.s.i.g to remove distortions in said pile fabric without involving heat.

2. The process according to claim 1, wherein said fabric is sprayed on said back of said fabric at an angle ranging between 0 and 70 degrees from a line normal to said back of said fabric.

3. The process according to claim 1, wherein said fabric is sprayed on said back of said fabric at an angle ranging between 10 and 50 degrees from a line normal to said back of said fabric.

4. The process according to claim 1, wherein said fabric is sprayed on said back of said fabric at an angle ranging between 20 and 40 degrees from a line normal to said back of said fabric.

5. The process according to claim 1, wherein said stream of liquid originates between 0.0625 inches and 24 inches from said fabric.

6. The process according to claim 1 wherein said stream of liquid originates between 1 inches and 15 inches from said fabric.

7. The process according to claim 1, wherein said stream of liquid originates between 4 inches and 10 inches from said fabric.

8. The process according to claim 1, including the additional step of heat treating said pile fabric for permanently fixing pile orientation of said pile fabric after said step of being sprayed by liquid.

9. The process according to claim 8, wherein said front of said fabric is heated between 150 and 320 degrees Fahrenheit and said back of said fabric is heated between 145 and 310 degrees Fahrenheit.

10. The process according to claim 8, wherein said front of said fabric is heated between 190 and 300 degrees Fahrenheit and said back of said fabric is heated between 180 and 290 degrees Fahrenheit.

11. The process according to claim 8, wherein said front of said fabric is heated between 200 and 290 degrees Fahrenheit and said back of said fabric is heated between 190 and 280 degrees Fahrenheit.

12. An apparatus for removing distortions in pile fabric, having a front and back, comprising a plurality of spray nozzles and a means to directly deliver liquid under a peak dynamic pressure in excess of about 10 p.s.i.g. on said back of said pile fabric and a means to operatively connect said spray nozzles to said means to deliver liquid under pressure to remove distortions in said pile fabric without involving heat.

13. An apparatus as defined in claim 12, wherein said nozzles are flat spray nozzles.

14. An apparatus as defined in claim 12, wherein said nozzle has an opening with a minimum cross sectional dimension in the range of between 0.000019 square inches to 0.79 square inches.

15. An apparatus as defined in claim 12, wherein said nozzle has an opening with a minimum cross sectional dimension in the range of between 0.003 square inches to 0.19 square inches.

16. An apparatus as defined in claim 12, wherein said nozzle has an opening with a minimum cross sectional dimension in the range of between 0.012 square inches to 0.027 square inches.

17. An apparatus as defined in claim 12, wherein said means to deliver liquid under pressure is a manifold.

18. An apparatus as defined in claim 12, wherein said means to operatively connect said spray nozzle to said means to deliver liquid is by threaded interconnection.

19. An apparatus as defined in claim 12, wherein said nozzle emits a stream of liquid at a peak dynamic pressure that ranges between 10 p.s.i.g. and 600 p.s.i.g.

* * * * *